United States Patent [19]
Gragson
[11] 4,165,291
[45] Aug. 21, 1979

[54] OVERBASING CALCIUM PETROLEUM SULFONATES IN LUBRICATING OILS EMPLOYING MONOALKYLBENZENE

[75] Inventor: James T. Gragson, Bartlesville, Okla.

[73] Assignee: Phillips Petroleum Company, Bartlesville, Okla.

[21] Appl. No.: 917,441

[22] Filed: Jun. 20, 1978

[51] Int. Cl.[2] ..... C10M 1/40; C10M 3/34; C10M 5/22; C10M 7/38

[52] U.S. Cl. ..... 252/33; 252/18; 252/400 R

[58] Field of Search ..... 252/33, 18, 400 R

[56] References Cited

U.S. PATENT DOCUMENTS

| | | | |
|---|---|---|---|
| 3,223,630 | 12/1965 | Gragson | 252/33 |
| 3,312,618 | 4/1967 | Le Suer et al. | 252/33 |
| 3,523,897 | 8/1970 | De Vault | 252/32.7 |
| 3,523,898 | 8/1970 | De Vault | 252/33 |
| 3,523,899 | 8/1970 | De Vault | 252/33 |
| 3,537,996 | 11/1970 | Holst et al. | 252/33 |
| 3,830,739 | 8/1974 | Kemp | 252/33.4 |
| 3,857,790 | 12/1974 | Saunders et al. | 252/33.4 |
| 4,086,170 | 4/1978 | De Clippelier et al. | 252/33 |

FOREIGN PATENT DOCUMENTS

| | | |
|---|---|---|
| 264 | 10/1979 | 252/33 |

*Primary Examiner*—Delbert E. Gantz
*Assistant Examiner*—Irving Vaughn

[57] ABSTRACT

A calcium petroleum sulfonate containing lubricating oil is overbased using lime, carbon dioxide, a low boiling alcohol and a monoalkylbenzene solvent. In one embodiment a propane-fractionated lubricating oil, calcium petroleum sulfonate, toluene, methanol and hydrated lime are treated with carbon dioxide at a temperature of about 60° C. for about 20 minutes. A resulting overbased calcium petroleum sulfonate obtained exhibited a base number of 315.

21 Claims, No Drawings

OVERBASING CALCIUM PETROLEUM SULFONATES IN LUBRICATING OILS EMPLOYING MONOALKYLBENZENE

This invention relates to overbasing a calcium petroleum sulfonate in the preparation of a lubricating oil additive. In one of its aspects the invention relates to the production of a high total base number (TBN) calcium petroleum sulfonate for use as an additive in lubricating oils, particularly crankcase oils for internal combustion engine to impart detergency and reduce sludge formation.

In one of its concepts the invention provides a process for overbasing a calcium petroleum sulfonate containing a lubricating oil to prepare an additive which comprises dissolving a lubricating oil fraction and a calcium petroleum sulfonate in a monoalkylbenzene, e.g., toluene, and a low boiling alcohol, e.g., methanol, adding lime and causing carbon dioxide to react with the mixture thus obtained.

In another of its concepts the invention limits the amount of alcohol employed. In a further concept of the invention the rate of stirring or agitation of the reaction mixture during addition of the carbon dioxide is controlled with respect to the TBN desired.

Overbased calcium petroleum sulfonates are useful as additives for lubricating oils, particularly crankcase oils for internal combustion engines. These materials impart detergency to lubricating oils and thus assist in keeping internal engine parts clean and reducing sludge formation in the oil. By increasing the alkaline reserve of the additive, equivalent detergency is obtained with a lower concentration of additive in the lubricating oil. Also, higher alkaline reserve neutralizes larger quantities of acidic combustion products which accumulate in the oil. Previously known processes for overbasing calcium petroleum sulfonates have experienced difficulty in obtaining sufficiently high alkaline reserves, e.g., TBN of 300 mg KOH/gm or higher, to enable the formulator to use lower amounts of additive while maintaining equivalent detergency or to adequately protect the engine under conditions of high acid formation in the combustion process.

Alkaline reserve can be measured by total base number, (TBN), which is the number of milligrams of potassium hydroxide equivalent to the amount of acid required to neutralize the alkaline constituents present in one gram of sample. A compound having a base number higher than can be obtained from the calcium petroleum sulfonate alone is said to be "overbased" sometimes "superbasic."

Petroleum sulfonic acid which is neutralized to form petroleum sulfonates normally includes appreciable amounts of various hydrocarbons not having the acid group so that when the sulfonate is formed, the resulting product is a mixture of hydrocarbons and petroleum sulfonates. When the sulfonic acid is neutralized with an excess of CaO or $Ca(OH)_2$ to form the sulfonate, the resulting product has a relatively small alkaline reserve. Addition of a large excess of neutralizing material normally does not materially increase the alkaline reserve beyond this point, since the excess material is removed, for example by filtration, prior to the use of the sulfonate in a lubricant.

It is an object of this invention to prepare an overbased calcium petroleum sulfonate lubricating additive having a high TBN. It is another object of this invention to provide a process or method whereby a desirably high TBN calcium petroleum sulfonate-lubricating oil additive can be prepared taking into account certain process conditions.

Other aspects, concepts, and objects and the several advantages of the invention are apparent from a study of this disclosure and the appended claims.

According to the invention there is provided a process for overbasing a calcium petroleum sulfonate containing oil to prepare a lubricating oil additive which comprises dissolving a lubricating oil fraction and a calcium petroleum sulfonate in a monoalkylbenzene solvent, having present in the solution a relatively small amount of a low boiling alcohol and hydrated lime and introducing carbon dioxide into the mixture in a manner to obtain a high TBN overbased product.

Also according to the invention the rate of agitation of the reaction mixture while adding carbon dioxide can be correlated with the TBN of the product produced. Thus by adjusting the rate of agitation during introduction of the carbon dioxide into the mixture a desirably high TBN or optimum TBN can be obtained.

Still further according to the invention, the alcohol content of the mixture is regulated to be sufficient to effect the desired overbasing but insufficient to produce an intractable gelled product.

Hereinafter the mixture resulting from neutralization of petroleum sulfonic acid will be referred to as "calcium petroleum sulfonate."

Thus, according to this invention, an overbased calcium petroleum sulfonate is prepared by contacting a mixture comprising a diluent oil, calcium petroleum sulfonate, lime [CaO and/or $Ca(OH)_2$], a low boiling alcohol, e.g., methanol, and monoalkylbenzene with carbon dioxide under conditions suitable to effect a desirable carbonation to thus produce a calcium petroleum sulfonate composition of increased alkaline reserve.

U.S. Pat. No. 3,223,630 issued Dec. 14, 1965, J. T. Gragson, relates to a process for increasing the base number of a calcium sulfonate of a high viscosity paraffinic petroleum lubricating stock by contacting with a calcium compound produced by passing carbon dioxide through a mixture comprising methanol and calcium oxide or calcium hydroxide. The disclosure of the patent is incorporated herein by reference.

In producing the sulfonated petroleum material of this invention, the base stock is selected from highly paraffinic, deasphalted and solvent-refined petroleum fractions having a viscosity of about 180 to 230 SUS at 210° F. and having a viscosity index of at least about 85. A preferred material is a propane fractionated, solvent-extracted and dewaxed Mid-Continent oil of about 200 to 215 SUS at 210° F. and having a viscosity index of about 85 to 100 or higher. The residual material from the propane fractionation contains the rejected asphalt and aromatic oils. Following the propane fractionation step the overhead oil fraction is solvent-extracted to remove additional aromatic hydrocarbons.

These oils are contacted with sulfonating agents such as fuming sulfuric acid, chlorosulfonic acid and sulfur trioxide, a particularly preferred sulfonating agent being a solution of sulfur trioxide in liquid sulfur dioxide. The petroleum stocks are contacted with the sulfonating agents at a temperature of from about 50° to 200° F. preferably from 80° to 150° F. for about 1 to 90 minutes. The ratio of sulfonating agent to oil can vary considerably, but generally is within the range of from about 0.04:1 to 1:1 on a weight basis, the sulfonating agent being calculated as 20 percent fuming sulfuric acid or equivalent.

The effluent from the sulfonation step is a petroleum sulfonic acid and this material is converted to an overbased calcium petroleum sulfonate. In one method, the petroleum sulfonic acid is contacted with an aqueous slurry of lime. Preferably, the petroleum sulfonic acid mixture has been flashed to remove $SO_2$, which can be recycled, and also diluted with a hydrocarbon such as naphtha. Sufficient lime is employed to neutralize the sulfonic acid present. The resulting solution of calcium petroleum sulfonate is then stabilized by heating under pressure, as for example 350° to 500° F. at 150 to 250 psig. The water is removed from the stabilized solution by such methods as evaporation. The solution of calcium petroleum sulfonate then can be overbased by carbonation in situ.

In a preferred embodiment of my invention the methanol, monoalkylbenzene compound, diluent oil and calcium oxide and/or calcium hydroxide are added to the neutralized sulfonated petroleum material prior to treatment with carbon dioxide. A selected petroleum stock is introduced to a sulfonation zone. A sulfonating agent such as sulfur trioxide dissolved in sulfur dioxide is introduced to the sulfonation zone. The reaction products are transported to a flash zone wherein sulfur dioxide is removed. The remaining reaction product passes to neutralization zone wherein it is diluted with a hydrocarbon solvent such as a naphtha and is neutralized by a slurry of CaO and/or $Ca(OH)_2$, such as an aqueous slurry of lime. The resulting neutralized slurry comprising calcium sulfate, calcium hydroxide, calcium petroleum sulfonate, petroleum sulfonic acid, water and naphtha is passed to a stabilization zone wherein the reaction product is maintained in the presence of the calcium hydroxide at elevated temperature and elevated pressure so that the base number of the sulfonate is raised as high as possible by this action. The stabilized material is then passed into a drying zone in which substantially all of the water is removed producing a stabilized and dehydrated reaction product.

In a more preferred process, a filtration zone which has been employed is eliminated. In this manner excess calcium oxide and/or calcium hydroxide present in the effluent from the drying zone is retained whereby the amount of calcium oxide and/or calcium hydroxide introduced for overbasing can be reduced. The product stream from the dryer is referred to as "dryer tower bottoms" (DTB).

When it is desired to include a filtration step it is desirable, in most instances, to add a solvent such as naphtha to facilitate the filtration. A solids-containing stream is removed, obtained while the filtrate comprising the calcium petroleum sulfonate is continued through an optional flash zone wherein, if desired, volatile materials, such as naphtha, are partially or totally removed and thence passed into a mixing zone wherein calcium oxide and/or calcium hydroxide, methanol, diluent oil and solvent containing monoalkylbenzene are added. The mixture then is contacted with carbon dioxide which is bubbled through the mixture. The $CO_2$ treated material is passed to a flash zone from which methanol and water are removed. The residue is filtered obtaining a solids-containing stream. The product is fractionated to remove volatiles. Overbased calcium petroleum sulfonate is removed from the fractionation.

The monoalkylbenzene compound employed in the carbonation operation of this invention will generally be selected from toluene or ethylbenzene, though it is possible to employ monoalkylbenzenes with alkyl groups containing 3 or 4 carbon atoms. However, when monoalkylbenzenes higher in molecular weight than toluene are employed, greater precautions and control of operating conditions must also be employed to prevent gellation of the product. Thus toluene is the preferred monoalkylbenzene.

The solvent system for the carbonation can be monoalkylbenzene alone or monoalkylbenzene in combination with common aliphatic hydrocarbon solvents, such as naphtha, Stoddard solvent, etc.

The proportion of monoalkylbenzene in the solvent is generally in the range of 25 to 100 percent by weight based on total solvent and preferably in the range of 40 to 100 weight percent.

The amount of solvent normally employed in the carbonation step can vary over wide ranges depending on, e.g., fluidity of the calcium petroleum sulfonate/-diluent oil. Generally useful ranges of solvent concentration are 50–90 weight percent and preferably 60–85 weight percent based on total calcium petroleum sulfonate, diluent oil and solvent.

The temperature employed in the carbonation step can range generally from about 25° to 80° C., but it has been found that higher total base number and improved filterability are obtained at higher temperatures of carbonation, e.g., 40° to 65° C. Since temperatures above 65° C. exceed the boiling point of methanol at atmospheric pressure and hence suitable containment means would be needed, in order to obtain high alkaline reserve and yet to operate in convenient, conventional equipment, it is more preferred to carbonate the reaction mixture at about 45°–60° C.

The amount of carbon dioxide added during the carbonation step will generally be from 0.2 to 0.8 moles carbon dioxide per mole of CaO or $Ca(OH)_2$ added in excess over that required to neutralize the petroleum sulfonic acid. It is preferable to employ from 0.4 to 0.8 moles $CO_2$ per mole excess CaO or $Ca(OH)_2$. When larger amounts of $CO_2$ are added little additional alkaline reserve is obtained and problems in workup and product quality, e.g., filterability, viscosity and gel formation, begin to appear.

The calcium oxide and/or calcium hydroxide added in the neutralization step will generally be at least the stoichiometric amount needed to neutralize the petroleum sulfonic acid. Generally, an excess of lime, e.g., up to about 100 percent excess, is added in the neutralization step. If the reaction product is to be filtered after neutralization, it is usually desirable to avoid large excesses of lime since the excess is removed in the filtration step. On the other hand, if filtration is not employed after neutralization, any excess lime will be retained in the reaction mixture and subsequently utilized in the overbasing operation.

The amount of excess lime added to the calcium petroleum sulfonate for overbasing will be dependent on the desired alkaline reserve. A useful relationship for determining the approximate total base number to be expected from a particular amount of lime employed is:

$$TBN=(1515)(\text{gm xs lime}^{b})(\text{mole } CO_2/\text{mole xs lime}^{c})/[(\text{gm. Ca pet. sulf.}^{a})+(1.35)(\text{gm xs lime})]$$

a. Weight in grams of calcium petroleum sulfonate plus diluent oil.
b. Weight in grams of lime added in excess to that required for neutralization.
c. Ratio of moles $CO_2$ per mole lime [CaO and/or $Ca(OH)_2$] added in excess to that required for neutralization.

Thus, for example, if 300 TBN is desired then the minimum amount of lime (assuming 0.8 mole $CO_2$/mole xs lime) that can be employed is 37.2 weight percent based on calcium petroleum sulfonate plus diluent oil.

The diluent oil which is suitable for use in this invention is a solvent-refined, substantially paraffinic oil generally having a viscosity of about 50 to 300 SUS at 37.5° C. such as that obtained as the lubricating oil fraction of a Mid-Continent crude oil. Particularly suitable is a Mid-Continent solvent-refined paraffinic neutral oil having a viscosity of about 96 to 98 SUS at 37.5° C., which is suitable for formulating into lubricating oils of SAE-10 weight.

The diluent oil is generally employed in amounts ranging from 25 to about 75 weight percent and preferably 40 to 60 weight percent based on total calcium petroleum sulfonate and diluent oil. It will be recognized by one skilled in the art that higher amounts of oil will not interfere with the overbasing operation, but will simply dilute the alkaline reserve in the resulting composition to the point that economic feasibility is diminished. On the other hand, use of lower amounts of diluent oil will result in a product which is very viscous and difficult to dry and to handle.

It will be recognized by one skilled in the art that the use of diluent oil as described for this invention will effectively dilute the alkaline reserve of the overbased calcium petroleum sulfonate. Thus a product of this invention with total base number of 300 prepared using 50 weight percent diluent oil if calculated on a diluent oil-free basis would exhibit a total base number significantly higher, i.e., approaching 600.

The following specific examples illustrate the advantage of the process of this invention. In all instances the oil which was sulfonated was a propane fractionated, phenol extracted and dewaxed Mid-Continent lubricating oil fraction of about 203 SUS viscosity at 210° F. and a viscosity index of about 93. This charge stock was sulfonated with a solution of about 10 weight percent $SO_3$ in liquid $SO_2$ at 110° F. for about 10 minutes. The $SO_3$ to oil weight ratio was about 0.08 to 1. The sulfonation effluent was flashed to remove $SO_2$, leaving a solution of about 48 weight percent petroleum sulfonic acid in unsulfonated oil. This mixture was then diluted with petroleum naphtha and neutralized by addition of an aqueous slurry of calcium hydroxide more than chemically equivalent to the sulfonic acid present. This mixture was stabilized by heating, followed by drying in a flash tower. The product recovered at this point is termed "dryer tower bottoms" and contains 19–20 weight percent each of calcium petroleum sulfonate and unsulfonated oil, and about 0.76 weight percent $Ca(OH)_2$, about 1–2% by weight $CaSO_4$ and $CaSO_3$, about 0.24 weight percent water; and the remainder is naphtha. The dryer tower bottoms are diluted with additional solvent and filtered to remove the solids. The solvent is then removed to produce a concentrate which is substantially 50 weight percent calcium petroleum sulfonate and 50 eight percent unsulfonated oil, this product being referred to as the "additive concentrate" in the subsequent examples, and has a base number of about 7.5.

EXAMPLE I

The following inventive run, 1, demonstrates the preparation of overbased calcium petroleum sulfonate in the presence of toluene.

A mixture comprising 10 gm. of the above-described additive concentrate, 10 gm. of propane fractionated Mid-Continent lubricating oil fraction of about 96–98 SUS viscosity at 37.5° C. and a viscosity index of about 105, 40 gm. toluene, 3 gm. methanol and 12 gm. hydrated lime were mixed in a stirred 100 ml glass reactor and heated at 60° C. Carbon dioxide (5.3 gm.) was bubbled through the mixture over a period of 20 minutes. The resulting mixture was heated at 110° C. to expel methanol and water, was filtered to remove solids and was stripped of solvent. The resulting overbased calcium petroleum sulfonate exhibited a base number of 315. Approximately 72 percent of the lime was converted to calcium carbonate.

EXAMPLE II

The following inventive runs, 2 and 3, and comparative runs, 4 to 7, were made to demonstrate the higher alkaline reserves attained in overbased calcium petroleum sulfonates employing the present invention compared to those made in the presence of solvents other than monoalkylbenzenes.

The runs of this example were conducted as described in Example I except that the carbonation was allowed to proceed at 54.5° C. In Table I the total base numbers of the resultant overbased calcium petroleum sulfonates are given.

TABLE 1

| Run No. | Solvent | TBN |
|---|---|---|
| 2 (Inv.) | toluene | 315 |
| 3 (Inv.) | ethylbenzene | 330 |
| 4 (Comp.) | naphtha | 248 |
| 5 (Comp.) | Stoddard solvent | 199 |
| 6 (Comp.) | xylene | 220,242[a] |
| 7 (Comp.) | tetralin | 247,275[a] |
| 8 (Comp.) | methyl isobutyl ketone | [b] |

[a]Duplicate determinations
[b]No Carbonation occurred

The results in Table I indicate that only using monoalkylbenzenes, especially toluene and ethylbenzene, were TBN's of over 300 attained.

Herein and in the claims "lime" is to be understood to include "hydrated lime" and vice versa.

EXAMPLE III

The following inventive and com parative runs demonstrate the criticality of the amount of methanol present during the overbasing operation.

The runs of this example were conducted as earlier described except that carbonation was allowed to proceed at 54.5° C. and the amount of methanol was varied as tabulated in Table II.

Table II

| Run No. | Methanol, %[a] | TBN | Remarks |
|---|---|---|---|
| 9 (Comp.) | 0 | 0 | No overbasing |
| 10 (Comp.) | 1.6 | 0 | No overbasing |
| 11 (Comp.) | 2–3 | —[b] | Murky filtrate |
| 12 (Inv.) | 5 | 315 | Filtered well |
| 13 (Comp.) | 10 | 200 | Grease-like product |

Table II-continued

| Run No. | Methanol, %[a] | TBN | Remarks |
|---|---|---|---|
| 14 (Comp.) | 15 | —[b] | Intractable gel |

[a]Weight percent based on total of oil, calcium petroleum sulfonate, and solvent.
[b]Not determined.

The above runs indicate that a certain minimum amount of methanol is necessary for overbasing to occur and that above a certain maximum amount of methanol product thickening and gel formation occurs.

EXAMPLE IV

The following inventive and comparative runs were conducted to demonstrate that increasing the amount of toluene in a solvent system comprising toluene and naphtha results in increased total base number.

The following runs were carried out as described in Example I except that the solvent composition varied as described in Table III and that the calcium petroleum sulfonate employed in runs 19 to 22 was the intermediate product streams described above in Example I as "dryer tower bottoms" (DTB) instead of the additive concentrate.

Table III

| Run No. | Sulfonate Feed | Toluene/ Naphtha[a] | TBN |
|---|---|---|---|
| 15 (Comp.) | additive concentrate | 0/100 | 199 |
| 16 | additive concentrate | 25/75 | 229 |
| 17 | additive concentrate | 50/50 | 292 |
| 18 | additive concentrate | 100/0 | 315 |
| 19 (Comp.) | DTB | 0/100 | 250 |
| 20 | DTB | 25/75 | —[b] |
| 21 | DTB | 50/50 | 311 |
| 22 | DTB | 100/0 | 325 |

[a]Weight ratio.
[b]Not determined.

The above results show the desirability of employing toluene alone or toluene in combination with naphtha as solvent for preparing overbased calcium petroleum sulfonate with high total base number.

EXAMPLE V

The following runs demonstrate the advantage of employing overbased calcium petroleum sulfonates prepared according to this invention in lubricating oil formulations compared to overbased calcium petroleum sulfonates prepared in the absence of monoalkylbenzene.

The following inventive runs 23 and 26 were carried out using overbased calcium petroleum sulfonates prepared generally as described in Example I with varying amounts of lime to obtain the desired TBN. Comparative runs 24 and 25 employed overbased calcium petroleum sulfonates prepared as described in U.S. Pat. No. 3,223,630 (issued Dec. 14, 1965), Example I, run 1, with varying amounts of lime to obtain the desired TBN.

The overbased calcium petroleum sulfonates were employed as detergents in an SAE 10W-40 lubricating oil formulation in the amounts recorded below in Table IV. An engine test was conducted on the formulation with the results recorded in Table IV. The engine test employed the conditions specified in Sequence III-C test (ASTM Reference STP 315G, "Multicylinder Test Sequences for Evaluating Automotive Engine Oils", page 63) except that the test was run for 128 hours instead of the specified 64 hours to increase the severity of the test.

TABLE IV

| Run No. | 23 | 24 | 25 | 26 |
|---|---|---|---|---|
| Solvent | toluene | naphtha | naphtha | toluene |
| TBN | 220 | 200[b] | 250 | 300 |
| Volume % | 2.5 | 2.73 | 2.15 | 1.7 |
| Viscosity Increase, % at 34.5° C. | | | | |
| at 88 Hr. | 224 | 311 | 345 | 162 |
| 96 hr. | 245 | 687 | 563 | 184 |
| 104 hr. | 283 | —[a] | 1,100 | 210 |
| 112 hr. | 355 | — | —[a] | 229 |
| 120 hr. | 519 | — | — | 274 |
| 128 hr. | 972 | — | — | 405 |

[a]Too viscous to measure.
[b]Product with 200 TBN was prepared by blending product of 100 TBN prepared in naphtha with product of 300 TBN prepared in toluene.

The above data demonstrate that lubricating oil additive prepared according to this invention provide greater protection against viscosity increase in lubricating formulations than prior art additives prepared using naphtha as solvent during carbonation. It will be observed from run 23 that inventive additive with 220 TBN provided greater such protection than prior art additive of 250 TBN in run 25. Inventive additive of 300 TBN in run 26 compared to inventive additive of 220 TBN in run 23 demonstrates the desirability of employing an overbased calcium petroleum sulfonate of high alkaline reserve in lubricating oil formulations.

EXAMPLE VI

The following comparative run 27 demonstrates an attempt to overbase a calcium petroleum sulfonate/diluent oil composition employing magnesium hydroxide instead of the calcium hydroxide and/or calcium oxide required by this invention.

Run 27 was conducted as described in Example I with the exceptions that 9.5 gm $Mg(OH)_2$ was employed instead of hydrated lime and the carbonation was allowed to proceed at 54.5° C. During the carbonation step, no exothermicity was observed. The resulting isolated product exhibited a total base number of 4, thus indicating an unsuccessful attempt to overbase a calcium petroleum sulfonate using magnesium hydroxide.

I have observed that the degree of agitation can affect significantly the TBN of the product produced during addition of the carbonating agent, e.g., the carbon dioxide. Although it is not definitely known why, nor should the invention be limited thereby, it now appears that a too high degree of agitation somehow leads to a less efficient overbasing.

EXAMPLE VII

In this example (run 28) the data show that the rate or degree of agitation markedly influences the TBN of the product obtained.

A mixture comprising 20 gm of the above-described additive concentrate, 20 gm of propane fractionated Mid-Continent lubricating oil fraction of about 96–98 SUS viscosity at 37.8° C. and a viscosity index of about 105, 80 gm toluene, 6 gm methanol and 16 gm hydrated lime were mixed in a reactor heated at 60° C. and equipped with a twin counter revolving stirrer operated at high speed. After carbonation and product purification as described in Example I, the resulting overbased calcium petroleum sulfonate exhibited a total base number of 168.

Thus it is seen that the intensive mixing of run 28 resulted in significantly lower total base number (TBN of 168) than did the moderate mixing of run 1 (TBN of 315).

The low boiling alcohols suitable for use in this invention include those saturated aliphatic alcohols generally containing from one to four carbon atoms per molecule. Exemplary alcohols include methanol, ethanol, isopropanol, n-propanol, sec-butanol, tert-butanol, etc., and mixtures thereof. Methanol is now preferred, it appearing that it yields the most readily purifiable overbased product because the desired rate of filtration therewith is best achieved.

A minimum amount of low boiling alcohol is necessary for the overbasing step, but too much alcohol results in intractable gelled product. When the preferred alcohol, methanol, is employed, the amount is generally in the range of from about 3.5 to about 8 percent by weight based on total diluent oil plus calcium petroleum sulfonate plus solvent. The preferred amount of methanol is from 4 to 6 weight percent and more preferably about 5 weight percent.

Reasonable variation and modification are possible within the scope of the foregoing disclosure and the appended claims to the invention the essence of which is that a high TBN overbased calcium petroleum sulfonate containing lubricating oil can be obtained by employing in addition to a diluent lubricating oil, as described, a monoalkylbenzene solvent and a relatively small amount of a low boiling alcohol and, optionally, an aliphatic hydrocarbon solvent together with the monoalkylbenzene solvent, lime and/or calcium hydroxide (hydrated lime) being added as described to the mixture whereupon carbon dioxide is introduced thereto also as described.

I claim:

1. A process for overbasing a calcium petroleum sulfonate containing oil to prepare a lubricating oil additive which comprises dissolving a diluent lubricating oil fraction and a calcium petroleum sulfonate in a monoalkylbenzene solvent and in the presence of a relatively small amount of a low-boiling alcohol, and lime, introducing carbon dioxide into the mixture thus obtained in a gradual manner to obtain a high TBN overbased product.

2. A process according to claim 1 wherein the degree of agitation of the reaction mixture during addition of the carbon dioxide is correlated with the TBN of the product produced to obtain a high desirable overbasing.

3. A process according to claim 1 wherein the alcohol content of the mixture during carbon dioxide reaction is adjusted to be sufficient to effect the desired overbasing but insufficient to produce an intractable gel to product.

4. A process according to claim 3 wherein the alcohol is about 3.5 to about 8% by weight of the total of the oil, calcium petroleum sulfonate and solvent.

5. A process according to claim 3 wherein the carbon dioxide is in the approximate range of from about 0.2 to about 0.8 moles $CO_2$ per mole of lime added in excess over that needed to neutralize the petroleum sulfonic acid.

6. A process according to claim 5 wherein the temperature is in the approximate range of from about 25° to about 80° C. but insufficient to substantially remove alcohol from the mixture under the conditions prevailing during carbonation.

7. A process according to claim 1 wherein the monoalkylbenzene in the solvent is the approximate range of from about 25 to 100% by weight based on total solvent.

8. A process according to claim 1 wherein the monoalkylbenzene is at least one of toluene and ethylbenzene.

9. A process according to claim 2 wherein the monoalkylbenzene is at least one of toluene and ethylbenzene.

10. A process according to claim 3 wherein the monoalkylbenzene is at least one of toluene and ethylbenzene.

11. A process according to claim 4 wherein the monoalkylbenzene is at least one of toluene and ethylbenzene.

12. A process according to claim 5 wherein the monoalkylbenzene is at least one of toluene and ethylbenzene.

13. A process according to claim 6 wherein the monoalkylbenzene is at least one of toluene and ethylbenzene.

14. A process according to claim 7 wherein the monoalkylbenzene is at least one of toluene and ethylbenzene.

15. A process according to claim 1 wherein the monoalkylbenzene is at least one having from 1–4 carbon atoms in the alkyl group.

16. A process according to claim 1 wherein the low boiling alcohol is methanol.

17. A process according to claim 1 wherein the solvent contains monoalkylbenzene and an aliphatic hydrocarbon solvent.

18. A process according to claim 1 wherein the diluent lubricating oil is a solvent refined, substantially paraffinic oil having an SUS viscosity at 37.8° C. in the approximate range 50–300.

19. A process according to claim 18 wherein the diluent lube oil is a Mid-Continent, solvent-refined paraffinic neutral oil having an SUS viscosity in the approximate range of from about 96 to about 98 37.5° C. and suitable for formulation into a lube oil of SAE-10 weight.

20. A process according to claim 5 wherein the temperature is in the approximate range of from 40° to 65° C.

21. A process according to claim 18 wherein the temperature during the introduction of carbon dioxide is in the approximate range of from about 45° to about 60° C.

* * * * *

UNITED STATES PATENT AND TRADEMARK OFFICE

CERTIFICATE OF CORRECTION

PATENT NO. : 4,165,291

DATED : August 21, 1979

INVENTOR(S) : James L. Gragson

It is certified that error appears in the above-identified patent and that said Letters Patent are hereby corrected as shown below:

Column 9, line 40, after "sulfonate" insert --- containing petroleum sulfonic acid ---

Column 10, line 49, after "98" insert --- at ---

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*